US005322634A

United States Patent [19]

Holubka et al.

[11] Patent Number: 5,322,634

[45] Date of Patent: Jun. 21, 1994

[54] ELECTRORHEOLOGICAL FLUIDS COMPRISING PHENOXY ORGANOMETALLIC SALT PARTICULATE

[75] Inventors: Joseph W. Holubka, Livonia; Chi Li, Orchard Lake, both of Mich.

[73] Assignee: Ford Motor Company, Dearborn, Mich.

[21] Appl. No.: 760,267

[22] Filed: Sep. 16, 1991

[51] Int. Cl.[5] ..... C10M 169/04; C10M 171/00

[52] U.S. Cl. ..... 252/74; 252/42.7; 252/572; 556/113; 556/135; 556/150

[58] Field of Search ..... 252/74, 572, 42.7; 556/135, 113, 150

[56] References Cited

U.S. PATENT DOCUMENTS

| | | | |
|---|---|---|---|
| 2,197,833 | 4/1940 | Reiff | 556/135 |
| 2,197,834 | 4/1940 | Reiff et al. | 556/135 |
| 2,402,448 | 6/1946 | Richard | 252/42.7 |
| 2,480,823 | 9/1949 | Morris et al. | 556/150 |
| 2,672,445 | 3/1954 | Stewart et al. | 252/42.7 |
| 2,672,447 | 3/1954 | Stewart et al. | 252/574 |
| 2,672,448 | 3/1954 | Newnan et al. | 252/578 |
| 2,795,552 | 6/1957 | Abbott et al. | 252/74 |
| 2,795,553 | 6/1957 | Lowe | 252/74 |
| 3,779,921 | 12/1973 | Patmore et al. | 252/33.6 |
| 3,839,210 | 10/1974 | Beiswanger et al. | 252/47.5 |
| 3,952,059 | 4/1976 | Nebzydoski et al. | 564/463 |
| 4,049,563 | 9/1977 | Burrous | 252/49.9 |
| 4,622,169 | 11/1986 | Rickle | 252/500 |
| 4,687,589 | 8/1987 | Block et al. | 252/73 |

*Primary Examiner*—Christine Skane

*Attorney, Agent, or Firm*—Lorraine S. Melotik; Roger L. May

[57] ABSTRACT

This invention is directed to an electrorheological fluid which comprises nonconductive particulate susceptible to ionic and electronic polarization dispersed in a nonconductive fluid. The nonconductive particulate are a phenoxy organometallic salt. This salt is the reaction product of an esentially stoichiometric amount of phenoxy salt soluble or dispersible in a liquid and a divalent metal salt. The phenoxy salt can be made by reacting diphenol material with active metal or active metal hydroxide.

15 Claims, 1 Drawing Sheet

ELECTRORHEOLOGICAL FLUIDS COMPRISING PHENOXY ORGANOMETALLIC SALT PARTICULATE

BACKGROUND OF THE INVENTION

1. Technical Field

This invention is directed to an electrorheological (ER) fluid comprising nonconductive particulate susceptible to ionic and electronic polarization dispersed in an nonconductive fluid.

2. Discussion of Relevant Art

It is generally known that ER fluids exhibit pronounced reversible changes in viscosity and resistance to shear in response to the application of an electric field. Such fluids generally comprise suspensions of finely divided, polarizable particles in an electrically nonconductive oil which can be rapidly and reversibly increased from the liquid to the plastic or solid state under the influence of a sufficiently powerful electric field. Both direct current electric fields and alternating current electric fields may be used for altering the viscosity. Such ER fluids are proposed for use, e.g., in shock absorbers and variable speed accessory drive clutches. As disclosed in U.S. Pat. No. 4,702,855, the particles generally comprise materials like zeolite, silicate, silica gel, and china clay. Fluids containing particles of such materials have the disadvantage that the particles have a tendency to settle.

It is an object of the present invention to provide an ER fluid which maintains a low fluid viscosity in an electric field. It is a further object of the present invention to provide an ER fluid which exhibits strong ER effects in an electric field. It is a further object of the present invention to provide an ER fluid whose particles remain substantially dispersed, avoiding the tendency to settle as is common with conventional ER fluids.

SUMMARY OF THE INVENTION

This invention is directed to an electrorheological fluid which includes nonconductive particulate susceptible to ionic and electronic polarization comprising a phenoxy organometallic salt dispersed in a nonconductive fluid. The phenoxy organometallic salt is the reaction product of an essentially stoichiometric amount of: (a) phenoxy salt which is soluble or dispersible in a liquid, and (b) divalent metal salt. The phenoxy salt is the reaction product of diphenol with active metal or its corresponding hydroxide (base). The active metal is selected from the group comprising alkali metals and alkaline earth metals. Preferably, the diphenol is a dihydroxy benzene or dihydroxy polyaromatic compound and the divalent metal salt is a Group II metal salt or transition metal salt. Preferably, the nonconductive fluid is a silicone oil or hydrocarbon-based oil. The density of the phenoxy organometallic salt preferably is similar to that of the nonconductive fluid. The invention, according to another embodiment, is directed to a method of making the electrorheological fluid disclosed above.

The present invention electrorheological fluid comprises phenoxy organometallic salt as the polarizable particulate material, which salt advantageously provides an increased ER effect because it has ionic fragments that increase ionic polarization and a conjugation in materials which increases electronic polarization. When exposed to an electric field, the present invention electrorheological fluid advantageously maintains low fluid viscosity so as to exhibit a strong ER effect.

DETAILED DESCRIPTION AND BEST MODE

Figure 1:
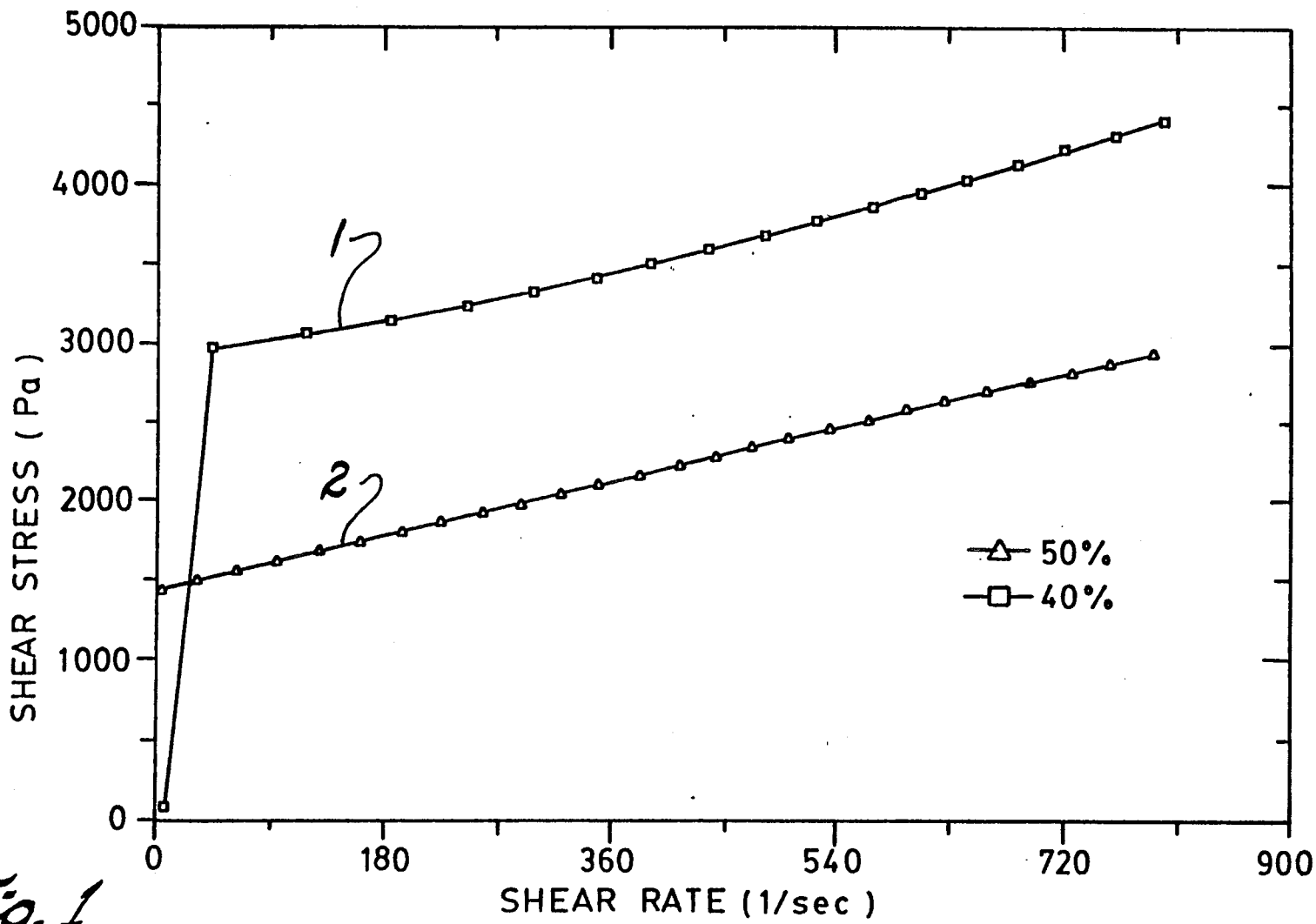
FIG. 1 graphically shows the flow curves of two embodiments of electrorheological fluids according to the present invention measured at 1000 V/mm.

The electrorheological fluid of the present invention comprises nonconductive particulate of phenoxy organometallic salt dispersed in a nonconductive fluid. The phenoxy organometallic salt is the reaction product of an essentially stoichiometric amount of: (a) phenoxy salt soluble or dispersible in a liquid, and (b) divalent metal salt. These materials as well as the method of making the electrorheological fluid will hereinafter be described in detail.

The phenoxy salt my be prepared by reacting any of a wide variety of diphenol materials with an active metal or its corresponding hydroxide in a liquid in which the phenoxy salt is soluble or dispersible. Active metals (and the corresponding active metal hydroxides) comprise the alkali metal group and alkaline earth metal group of the Periodic Table. Active metals include such alkali metals as sodium, potassium, and cesium, and such alkaline earth metals as magnesium and calcium.

Any liquid in which the phenoxy salt is soluble or dispersible may be employed in its preparation. This liquid should also be one in which the phenoxy organometallic salt is essentially insoluble. The liquid may be selected from inert solvents, water, and mixtures of water with inert solvents miscible with water. Exemplary inert solvents include polyether-type cellosolve solvents, toluene, diethyl ether, mineral spirits, and alcohols like methanol, ethanol, and propanol. Preferably, the employed liquid is water or a water/inert solvent mixture since most phenoxy salts are freely soluble in such liquids. If the invention involves the use of water-sensitive materials, the phenoxy salt may be prepared in an inert solvent. This approach affords the advantage of a dry product, but would suffer from the generation of hydrogen gas that may complicate processing of the materials. The use of active metal base is preferred over the use of active metals, with alkali metal bases like sodium hydroxide being most preferred.

The diphenol material may be selected from such materials as, but is not limited to, 1,2-, 1,3-, and 1,4-dihydroxy benzene. Preferred diphenol materials include dihydroxy materials derived from various polyaromatic materials like naphthalene, anthracene, pyrene, 9-pheylanthracene, and other related polyaromatic materials that are particularly able to delocalize the negative ionic charge generated as a result of the reaction of the diphenol material with active metal or active metal base as shown in the following FIGURE:

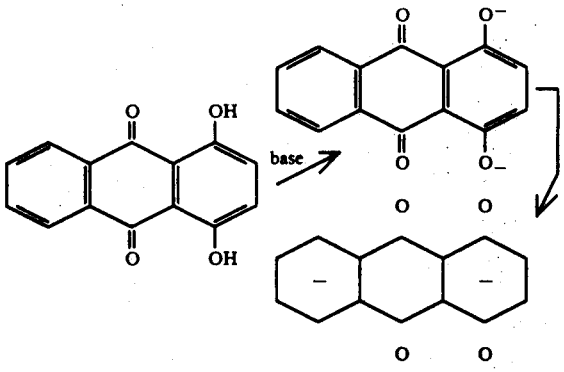

As shown in the FIGURE, a phenoxy anion is generated in which the hydroxy group is in conjugation with other double bounds in the polyaromatic compound. This allows the anion to provide a conjugated system capable of carrying a delocalized ionic charge so that the resultant phenoxy organometallic salt of the present invention has more prononuced ER effects because it is more easily polarized. More complex polyaromatic compounds, as, for example, those derived from 1,2,3,4,5-pentaphenyl-1,3-cyclopentadiene, are also appropriate for the invention. Especially strong ER effects have been achieved using as the diphenol material the isomers of 1,4-, 1,8- and 2,6-dihydroxy anthraquinones and materials incorporating the anthraquinone nucleui within other polyaromatic materials. Such materials contain a carbonyl oxygen in a position on the molecule such that complexes formed with the carbonyl oxygen and hydroxyl group with a metal ion form a five or six member ring as shown in the FIGURE below:

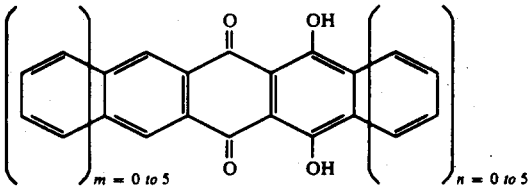

Still other diphenol materials useful in the invention will be apparent to those skilled in the art in view of the present disclosure. The diphenol and the active metal or active metal hydroxide are preferably employed in a ratio to provide one equivalent of metal ion for each hydroxyl group present on the diphenol in the reaction mixture.

To prepare the phenoxy organometallic salt, the phenoxy salt, most preferally a sodium phenoxy salt, is reacted with an essentially stoichiometric amount of divalent metal salt. Since the liquid in which the reaction takes place is soluble to the phenoxy salt but essentially insoluble to the phenoxy organometallic salt as disclosed herein, the latter precipitates out of the liquid. Preferably, the liquid is water or a water/solvent mixture; however, inert solvents like ketones may be employed as long as the resulting phenoly organometallic salt precipitates therefrom. Most preferred metal salts are those divalent metal salts derived from the transition metal series such as Zn(II), Cu(II), Ni(II), Fe(II) salts. Also useful are the divalent ions of other transition elements as well as the Group II elements such as magnesium and calcium; the Group II metals, however, are less preferred. The anion of the divalent metal salt may be an ion that forms a soluble salt, preferably being a water soluble salt, including chloride, nitrate, perchlorate, etc. The phenoxy organometallic salt that precipitates from this second reaction is filtered, thoroughly washed, dried, e.g., in a vacuum, and ground to appropriate particle size, preferably being, on average, about 20–30 μm in diameter, for incorporation into the ER fluid formulation.

To form the ER fluid, the particulate of the phenoxy organometallic salt are dispersed in in an inert, nonconductive fluid of low viscosity. The density of the fluid preferably is similar, or more preferably substantially identical, to the density of the particulate salt material. By using a fluid of density similar to that of the particulate, settling of the particulate is substantially precluded. The most preferred fluids for use in the invention are the silicon materials that have densities ranging from 0.91 to 0.98 and viscosities in the range of 0.05 to 1.0 Poise. Other fluids suitable for use in the electrorheological fluid of the invention include hydrocarbon-based oils such as transformer oil and mineral oil. Other useful fluids which may be employed in the present invention would be apparent to those skilled in the art in view of the present disclosure. Advantageously, there are many available suitable fluids whose densities are substantially comparable to that of the phenoxy organometallic salts of the present invention. The use of additives like dispersants and surfactants, e.g., copolymers of polydimethylsiloxane with polypropylene oxide, may be used to provide a stable (nonsettling) ER fluid when using particulate and fluids of more dissimilar densities.

The ER fluid formulation of the present invention is prepared by mixing preferably 10–50% by weight of one of the phenoxo organometallic salts of desired particulate size into a low visocisity fluid until the particles are well dispersed in the fluid. The amout of particulate salt may be increased to upwards of 70% by weight depending on the wetting ability of the fluid and the density of the particulate. Generally, the particulate would have diameters, on average, greater than about 5 μm but less than about 50 μm. Exemplary ER fluids according to the present invention show significant yield stresses ranging from 100–1500 Pa at field strengths varied from 200 V/mm-3000 V/mm. The viscosity of the fluid remains low; therefore, these fluids containing the particulate exhibit strong ER effects and would be useful for any applications which would benefit from materials exhibiting changes in yield stress and viscosity. For example, adjustable rate shock absorbers and auxilliary drive clutches can be designed using ER fluids.

EXAMPLE 1

Preparation of a phenoxy salt according to the present invention. A slurry of 4.84 g (0.02 mole) of 1,4-dihydroxy anthraquinone in a 1:1 (by volume) methanol/-water mixture (50 ml) was combined with solution of 1.6 g (0.04 mole) of sodium hydroxide in 10 ml of 1:1 (by volume) water/ethanol mixture. The resulting solution was stirred at room temperature for about 0.5 hours and then was used immediately in the preparation of the phenoxy organometallic salt.

EXAMPLE 2

Preparation of a zinc(II) organometallic phenoxy salt according to the present invention. A solution of 2.72 g (0.02 mole) of zinc chloride dissolved in 20 ml of methanol was added to the entire contents of the sodium phenoxy salt solution prepared in Example 1. A dark precipitate formed immediately. The resulting purple colored material was filtered, thoroughly rinsed first with water then with methanol, and subsequently dried. The phenoxy organometallic salt prepared in this example is powdered to a 20–30 μm size (diameter) and then dispersed in a nonconductive fluid as described in Example 3 to prepare an ER fluid according to the present invention.

EXAMPLE 3

Preparation of ER fluids according to the present invention based on a zinc(II) phenoxy organometallic salt. The ER fluid was prepared by mixing varying weight percents, from 10–50%, of the zinc(II) phenoxy organometallic salt prepared in Example 2 into a low viscosity silicon fluid (Dow Corning 400, Dow Corning Corp., Midland, Mich.) until the salt particles are well dispersed in the fluid. The ER fluids were then characterized in a Carri-Med Rheometer modified for ER fluid testing. FIG. 1 shows the flow properties of two of the ER fluids, particularly those with 40% particle loading (curve 1) and 50% particle loading (curve 2), both in the presence of a DC electric field of 1000 V/mm. The yield stress can be read from the Y-axis while the slope of the curve indicates the viscosity. The yield stress is 2850 Pa for fluid containing 50% salt and 1410 Pa for that containing 40% salt. Significant yield stresses ranging from 140–915 Pa were observed at field strengths varied from 200 V/mm-3000 V/mm at 35% salt content. The viscosity of the fluid remains at about 0.3–0.5 Poise, not very sensitive to the electric field. Therefore, these fluids containing the phenoxy organometallic salts exhibit strong ER effects. The rate of sedimentation is extreemely low due to the comparable densities of the particulate salt and the fluid.

EXAMPLE 4

Preparation of an iron(II) phenoxy organometallic salt according to the present invention. This salt was prepared according the procedure of Examples 1 and 2, except that ferrous chloride was used instead of zinc chloride. The resulting phenoxy organometallic material was then dispersed in the same kind of oil employed in Example 3 to generate an ER fluid according to the present invention. The ER fluid showed a 650 Pa yield stress and 0.21 Poise viscosity at a 2000 V/mm electric field strength.

EXAMPLE 5

Preparation of a nickel (II) phenoxy organometallic salt according to the present invention. This salt was prepared as described in Examples 1 and 2, except that nickel(II) chloride was used instead of zinc chloride. The resulting organometallic material was dispersed in the same low viscosity silicone oil, as was described in Example 3, to generate the electrorheological fluid. The material showed 476 Pa yield stress and 0.09 Poise viscosity at 2000 V/mm field strength.

EXAMPLE 6

Preparation of copper(II) phenoxy organometallic salt according to the present invention. This salt was prepared as described in Examples 1 and 2, except that copper(II) chloride was used instead of zinc chloride. The resulting organometallic salt was dispersed in the same low viscosity silicone oil as described in Example 3 to generate an ER fluid according to the present invention. The ER fluid showed 1410 Pa yield stress and 0.37 Poise viscosity at 2000 V/mm field strength.

EXAMPLE 7

Preparation of a phenoxy salt from 2,6-dihydroxvanthraquinone according to the present invention. A slurry of 4.84 g (0.02 mole) of 1.4-dihydroxy anthraquinone in 50 ml of a 1:1 methanol water mixture (by volume) was combined with a 10 ml of a 1:1 water/propanol solution containing 1.6 g (0.04 mole) of sodium hydroxide. The resulting material was stirred at room temperature for about 0.5 hours and then was used immediately in the preparation of the phenoxy organometallic salt in the following examples.

EXAMPLE 8–11

Preparation of phenoxy organometallic salts according to the present invention. The procedures described in Examples 1–6 were followed, except that 2,6-dihydroxy anthraquinone was employed in place of the 1,4-dihydroxy anthraquinone. The resultant ER fluids prepared from these salts exhibited the following yield stress and viscosity in an electric field:

for Zn(II): 610 Pa and 0.2 Poise at 2000 V/mm
for Fe(II): 494 Pa and 0.08 Poise at 2000 V/mm
for Ni(II): 1270 Pa and 0.31 Poise at 2000 V/mm
for Cu(II): 255 Pa and 0.17 Poise at 200 V/mm.

EXAMPLE 12

The same zinc (II) phenoxy organometallic salt as in Example 3 is dispersed in mineral oil (Aldrich Chemical Company, Milwaukee, Wis., Cat. No. 33, 076-0). The volume fraction of the salt in the oil is 40%. The ER fluid exhibits similar yield and viscosity as those in Example 3. (1400 Pa and 0.5 Poise at a 1000 V/mm field strength.)

EXAMPLE 13

The same zinc (II) phenoxy organometallic salt as in Example 3 is dispersed in low viscosity parafin oil (Aldrich Chemical Co., Milwaukee, Wis.). Various ER fluids are prepared, the volume fraction of salt varying from 20–50%. These ER fluids exhibit similar electrorheological properties as shown for the Example 3 ER fluid. (1000 Pa yield stress and 0.1 poise viscosity at 1000 V/mm.)

EXAMPLE 14

Preparation of a phenoxy salt from from 5,8-dihydroxy-1,4-naphthoquinone according to the present invention. A slurry of 3.8 g (0.02) mole of 5,8-dihydroxy-1,4-naphthoquinone in 50 ml of a 1:1 methanol/water mixture (by volume) is combined with 10 ml of a 1:1 water/propanol solution containing 1.6 g (0.04 mole) sodium hydroxide. The resulting solution is stirred at room temperature for about 0.5 hours and then is used immediately in the preparation of the phenoxy organometallic salt.

EXAMPLE 15

Preparation of a zinc (II) organometallic phenoxy salt from 5,8-dihydroxy-1,4-naphthoquinone salt according to the present invention. The zinc (II) organometallic phenozy salt derived from 5,8-dihydroxy 1,4-naphthoquinone is prepared in the manner described in Example 2, except that the naphoquinone salt replaces the anthraquinone salt. It is used to form an ER fluid as in Example 3 and exhibits similar ER properties.

We claim:

1. An electrorheological fluid comprising at least 10% by weight nonconductive particulate susceptible to ionic and electronic polarization dispersed in a nonconductive fluid;

said particulate comprising phenoxy organometallic salt which is the reaction product of an essentially stoichiometric amount of (A) phenoxy salt soluble or dispersible in a liquid and (B) divalent metal salt;

said phenoxy salt being the reaction product of (a) dihydroxy polyaromatic materials derived from polyaromatic compounds selected from the group consisting of naphthalene, anthracene, pyrene, 9-pheylanthracene and 1,2,3,4,5-pentaphenyl-1, 3-cyclopentadiene, or diphenol materials selected from the group consisting of 1,4-dihydroxy anthraquinone, 1,8-dihydroxy anthraquinone and 2,6-dihydroxy anthraquinones, and (b) component selected from the group consisting of alkali metal, alkaline earth metal, alkali metal hydroxide, and alkaline earth metal hydroxide.

2. The electrorheological fluid according to claim 1 wherein said component (b) is an alkali metal hydroxide.

3. The electrorheological fluid according to claim 1 wherein said dihydroxy polyaromatic materials and said component (b) are reacted in amounts which provide about one equivalent of metal ion for each hydroxyl group present on said dihydroxy polyaromatic materials.

4. The electrorheological fluid according to claim 1 wherein said divalent metal salt is selected from the group consisting of (i) Group II metal salts, and (ii) transition metal salts.

5. The electrorheological fluid according to claim 4 wherein said transition metals salts are salts of metals selected from the group consisting of (i) zinc (II), (ii) copper (II), (iii) nickel (II), and (iv) iron (II).

6. The electrorheological fluid according to claim 1 wherein said nonconductive fluid is selected from the group consisting of (i) silicone oils and (ii) hydrocarbon-based oils.

7. The electrorheological fluid according to claim 1 wherein said liquid comprises water.

8. A method for making an electrorheological fluid comprising:

dispersing at least 10% by weight nonconductive particulate susceptible to ionic and electronic polarization in a nonconductive fluid, said particulate comprising phenoxy organometallic salt which is the reaction product of an essentially stoichiometric amount of (A) phenoxy salt soluble or dispersible in a liquid and (B) divalent metal salt;

said phenoxy salt being the reaction product of (a) dihydroxy polyaromatic materials derived from polyaromatic compounds selected from the group consisting of naphthalene, anthracene, pyrene, 9-pheylanthracene and 1,2,3,4,5-pentaphenyl-1, 3-cyclopentadiene, or diphenol materials selected from the group consisting of 1,4-dihydroxy anthraquinone 1,8-dihydroxy anthraquinone and 2,6-dihydroxy anthraquinones, and (b) component selected from the group consisting of alkali metal, alkaline earth metal, alkali metal hydroxide, and alkaline earth metal hydroxide.

9. The method according to claim 8 wherein said said component (b) is an alkali metal hydroxide.

10. The method according to claim 8 wherein said dihydroxy polyaromatic materials and said component (b) are reacted in amounts which provide about one equivalent of metal ion for each hydroxyl group present on said dihydroxy polyaromatic materials.

11. The method according to claim 8 wherein said divalent metal salt is selected from the group consisting of (i) Group II metal salts and (ii) transition metal salts.

12. The method according to claim 11 wherein said transition metals salts are salts of metals selected from the group consisting of (i) zinc (II), (ii) copper (II), (iii) nickel (II), and (iv) iron (II).

13. The method according to claim 8 wherein said nonconductive fluid is selected from the group consisting of (i) silicone oils and (ii) hydrocarbon-based oils.

14. The method according to claim 8 wherein said liquid comprises water.

15. An electrorheological fluid comprising at least 10% by weight nonconductive particulate susceptible to ionic and electronic polarization dispersed in an nonconductive fluid;

said nonconductive particulate comprising phenoxy organometallic salt which is the reaction product of an essentially stoichiometric amount of:

(A) phenoxy salt soluble or dispersible in a liquid which is the reaction product of (a) dihydroxy polyaromatic materials derived from polyaromatic compounds selected from the group consisting of naphthalene, anthracene, pyrene, 9-phenylanthracene and 1,2,3,4,5-pentaphenyl-1, 3-cyclopentadiene, or diphenol materials selected from the group consisting of 1,4-dihydroxy anthraquinone, 1,8-dihydroxy anthraquinone and 2,6-dihydroxy anthraquinones, and (b) a component selected from the group comprising alkali metal, alkaline earth metal, alkali metal hydroxide, and alkaline earth metal hydroxide; and (B) divalent metal salt selected from the group consisting of (i) Group II metal salts and (ii) transition metal salts;

said nonconductive fluid being selected from the group consisting of silicone oils and hydrocarbon-based oils.

* * * * *